US005325781A

United States Patent [19]

Dupont et al.

[11] Patent Number: 5,325,781

[45] Date of Patent: Jul. 5, 1994

[54] METHOD FOR THE MANUFACTURE OF OBJECTS HAVING SUPERFICIAL RELIEF PATTERNS

[75] Inventors: Guy Dupont, Jurbise; Pierre Tissot, Bruxelles, both of Belgium; Joëlle Manceaux, Joinville Le Pont, France

[73] Assignee: Ferchim Engineering SA, Lausanne, Switzerland

[21] Appl. No.: 922,206

[22] Filed: Jul. 30, 1992

[30] Foreign Application Priority Data

Jul. 30, 1991 [CH] Switzerland ..... 02279/91

[51] Int. Cl.[5] ..... B41F 23/04; B05D 3/02

[52] U.S. Cl. ..... 101/487; 101/170; 101/491; 156/78; 427/373

[58] Field of Search ..... 101/129, 170, 487, 488, 101/491, DIG. 43; 156/77, 78, 79, 83, 272.8, 273.3, 273.5, 275.5; 427/177, 179, 336, 373, 554, 557

[56] References Cited

FOREIGN PATENT DOCUMENTS 0376322 7/1990 European Pat. Off. .
1290796 9/1972 United Kingdom .

OTHER PUBLICATIONS

Patent Abstracts of Japan, vol. 3, No. 0138 (C-138) Nov. 16, 1979, & JP, A, 54, 118 438 (Toppan Printing Co. Ltd.) Sep. 13, 1979.

Patent Abstracts of Japan, vol. 8, No. 170 (M-315) (1607) Aug. 7, 1984 & JP, A, 59 064 384 (Nihon Totsukiyo Kanri K.K.), Apr. 12, 1984.

*Primary Examiner*—Edgar S. Burr
*Assistant Examiner*—Christopher A. Bennett
*Attorney, Agent, or Firm*—Richard Linn

[57] ABSTRACT

The disclosed method relates to the formation of a relief pattern on the surface of a shaped object through the expansion of an expandable ink. The ink is applied on a support web and then dried. A varnish which polymerizes under UV radiation may be applied on the printed, dried support web. The printed, dried, and possibly varnished, support web is then rolled in to a coil. Afterwards, the coiled web is transformed into the desired shaped objects, such as filled and closed packages or security documents. The relief pattern may then be formed upon the surface of the object by irradiating the expandable ink. In particular, a laser beam may scan the surface of the object to form the relief pattern.

16 Claims, 1 Drawing Sheet

METHOD FOR THE MANUFACTURE OF OBJECTS HAVING SUPERFICIAL RELIEF PATTERNS

BACKGROUND OF THE INVENTION

The present invention generally refers to the art of printing. It concerns a method for the manufacture or the decoration of shaped objects of which at least one surface is provided with a generally but not exclusively decorative pattern in relief. More especially, the invention relates to the application of said method to packages of all types and of all solid materials which are printable and generally provided in a two-dimensional form. This term designates any material whose thickness is smaller than its length and width by several orders of magnitude. Examples are textile materials in web form, paper and cardboard in webs, metal sheets, metal foils such as aluminum or tin foils, plastics foils, and combinations or compounds (laminates) of the cited materials. This list is not exhaustive.

It is well known to provide the surfaces of a two-dimensional material with relief portions or patterns. For example, the different methods of embossing may be applied in order to obtain these decorative or functional relief patterns.

However, embossing has the drawback, inter alia, that while a positive pattern is produced on the back of a two-dimensional material, the negative of that same pattern is simultaneously formed on the upper surface of said material.

Attempts have been made to eliminate the drawbacks of embossing by developing so-called "inflatable (expanding) inks". These are printing inks which form reliefs by expansion at precise and desired locations, i.e. where the ink has been applied, under the action of heat or of energetic radiation capable of heating the printing. The heated ink will permanently expand at the printed sites, thus producing the desired relief. The back of the printed two-dimensional material remains unaltered. This "embossing" method by inflatable or expanding inks is known for the manufacture of wallpaper, for example.

This relief expansion procedure is carried out preferably by continuously printing one or a plurality of inflatable inks onto the two-dimensional support according to the desired pattern, by drying the printing, passing the printed material through an oven at e.g. 180° during or after drying, or otherwise applying the heat (e.g. by infrared radiation), and winding up the expanded support coming out from the oven.

However, serious problems arise when the printed and partially expanded support is wound up for a subsequent use, e.g., in the manufacture of packages. A tight winding cannot be obtained, and loosely wound rolls or bobbins are seriously deformed during stocking, transportation and handling, so as to become useless. Moreover, the relief is subject to mechanical abrasion.

As far as wallpaper is concerned, this problem is not important since this paper comes in quite short and thin rolls.

SUMMARY OF THE INVENTION

It is thus the principal object of the present invention to develop and establish a method which obviates the drawbacks discussed above. This is achieved by the method of the invention, wherein: a web of two-dimensional material is continuously printed with an ink which is capable of expanding under the action of heat, the printing is dried by applying a drying temperature which is inferior to the beginning of the expansion of the ink, the printed and dried web is coiled up, and the expansion of the ink is effected after the transformation of the web into shaped objects. Particular embodiments of the invention are defined in dependent claims.

Thus, the principal and fundamental idea of the invention is to continuously print a two-dimensional support with an ink which is capable of expanding under the action of thermal energy, but to prevent the expansion of the ink until the final phase of the method, i.e., the production of packages or other objects; in other words, the invention provides a delayed expansion of the ink.

The invention will be explained in more detail in the following description which refers to a package. The method can be adapted by the person skilled in the art to other applications which will be enumerated below.

As mentioned above, expanding inks are already known per se. The expanding inks in the present invention, however, are formulated and designed in accordance with their use in a method where expansion occurs, immediately after printing or drying in order to yield a raised image suggestive of an embossment. According to the present invention, the known expandable inks may basically be used, but it is preferable to modify them in such a manner that they respond to other requirements, namely to withstand mechanical impacts during winding, fashioning and other stresses before the time of expansion. Moreover, they must conserve their ability to expand over a long time which may last several weeks at least. On the other hand, the ink must not expand in the drying process.

Known expandable or inflatable inks generally contain the following constituents:

(A) a binder, selected from dispersions, emulsions and aqueous solutions of synthetic resins, having in particular the following characteristics:

film formation temperature between 0° and 50° C.

dilatation limit: 150 to 400% minimum resistance to light: 6 IWS, and (B) an expanding agent which is formed by microbubbles whose envelope consists of thermoplastic material and which contain a thermo-expansible, encapsulated substance, e.g., a hydrocarbon or another liquid which passes into the gas phase under the effect of heat. The diameter of said microbubbles or microcapsules is generally comprised between 10 and 20 μm. The microbubbles are described, for example, in U.S. Pat. No. 3,615,972.

The ink is composed of 50 to 95% of binder and 5 to 50% of expanding agent. It may contain coloring agents, solid filling and diluting agents, auxiliary agents, etc.

For the requirements of the invention, an expanding ink is used which has a long-term expanding ability and which does not expand below about 100° to 120° C. This allows a storability of several weeks, on one hand, and a normal drying of the printing made with the ink without any premature expansion. In order to fulfill the first condition, a soft, light-resistant polymer maintaining its flexibility over a long time is chosen as a binder. Moreover, in order to fulfill the second condition, microbubbles which contain a substance having a relatively high boiling or vaporization point are chosen.

The following is a typical formula of the expanding ink of the invention:

| Constituent | | Proportion, parts by weight |
|---|---|---|
| Binder: | ethylene-vinyl acetate copolymer in aqueous dispersion (VINNAPAS EP 400) | 610 to 700 |
| Expanding agent: | EXPANCEL 642 W4 | 160 to 260 |
| Auxiliary agents: | precipitated chalk (SOCAL P2) | 50 to 100 |
| | titanium oxide (TIPURE R 931) | 20 to 50 |
| | Antifoam BALAB 748 | 5 |
| | Silicone (TEGO AB 500) | 5 |

The expanding ink may be used in all printing methods allowing a sufficiently thick ink deposit, for example in flexographic printing, screen printing, photogravure, lithography, etc. Since the production speed must be high, i.e. up to about 150 m/min, a fast printing method such as photogravure is preferable. It is known to one skilled in the art how to adapt the ink to each printing method.

According to an important aspect of the invention, it has been found that the properties of the expandable but not yet expanded ink are best conserved and the mechanical resistance of the printing and of the expanded pattern at the end of the process are best ensured if the printing is covered by a transparent, ultraviolet (UV) hardening varnish. This varnish, which has also been adapted to the special conditions of the invention, is applied immediately after the basic printing formed by expandable or nonexpandable inks and must dry or polymerize very quickly. Heat cannot be applied since this would start to expand the ink. Moreover, it has been found that the varnish should be printed by photogravure, which requires still other modifications.

In order to fulfill the specific rheological conditions of photogravure, the viscosity of the varnish must be in the order of CF4 20 seconds. Consequently, as far as the formulation is concerned, prepolymers having a very low viscosity will be used which will be further reduced by means of monomers. An extreme dilution by means of solvents such as ethyl acetate or alcohol can also be considered.

Since the solids content of the varnish is high (100%), the gravure of the photogravure cylinder is adapted to produce 4 to 5 g/m$^2$ of dry deposition.

A production rate of the order of 150 m/min must be ensured; therefore a sufficiently reactive formula is needed.

This property is essentially dictated by considerations of chemical kinetics; acrylics, for example, are ten times more reactive than methacrylics. The used monomers are acrylic esters having a low viscosity. They are classified by their functionality: monoacrylate, diacrylate, and triacrylate. Thus the choice of the monomer type affects the properties of the polymerized film. Trifunctional monomers are very reactive and result in rapid crosslinking.

This necessary consideration is not sufficient to obtain a quick photocrosslinking of the coating under UV radiation since the direct absorption of the incident radiation by the polymerizable molecules is generally not possible. This is why a ultraviolet light receptor must be incorporated in the formula. This catalytic system ensures the production of free radicals after absorption of the actinic light.

When irradiating a polyfunctional acrylic derivate or a mixture of monofunctional and polyfunctional acrylics, a molecule is obtained whose structure is tridimensional and which will consequently be thermoresistant and insoluble in organic solvents. The formation of such a network reinforces the mechanical properties and the resistance of the film to chemical agents. With a constant concentration of photoinitiator and coinitiator, it further allows a speed up of the medium, i.e. to increase its reactivity.

The most delicate point of the formula is its flexibility, since, in view of the considerations set forth above, the required conditions of high reactivity inevitably lead to very firmly connected films. Yet, conversely, the UV varnish should be highly elastic to allow the expansion of the ink without resulting in a loss of adhesion or its deterioration. This is only possible if the change of volume of the ink film during its expansion is absorbed by the elasticity of the protecting varnish. The plastifying action of a mixture of certain monomers combined with the polyester acrylate type produces an elastic property without losing too much reactivity.

In the present field of application, the varnishes must also have a low smelling threshold. The degree of purity of the oligomers and of the monomers as well as the type of photoinitiator have been chosen to that effect, i.e., having a very low $LD_{50}$ value.

A typical formula of the UV varnish, capable of being printed by photogravure, is the following:

| Constituent | Proportion, parts by weight |
|---|---|
| 1. Polyester acrylate prepolymer EBERCRYL 830 | 40–43 |
| 2. Monomer for surface reticulation OTA 480 | 15–18 |
| 3. Monomer for surface reticulation TPGDA | 15–18 |
| 4. Photoinitiator for surface reticulation UVECRYL P36 | 8–12 |
| 5. Photoinitiator for surface reticulation UVECRYL P115 | 6–9 |
| 6. Photoinitiator for depth reticulation DAROCURE 1173 | 3–4 |
| 7. Wax POLYTRON 929 | 0.5–2.5 |

The varnish thus contains a prepolymer which serves as a substrate for radical induced crosslinking. In special cases, the prepolymer may also be omitted.

BRIEF DESCRIPTION OF THE DRAWINGS

In the appended drawing, two alternatives of the method of the invention are represented by way of example.

DETAILED DESCRIPTION OF THE PREFERRED EMBODIMENTS

Figure 1:
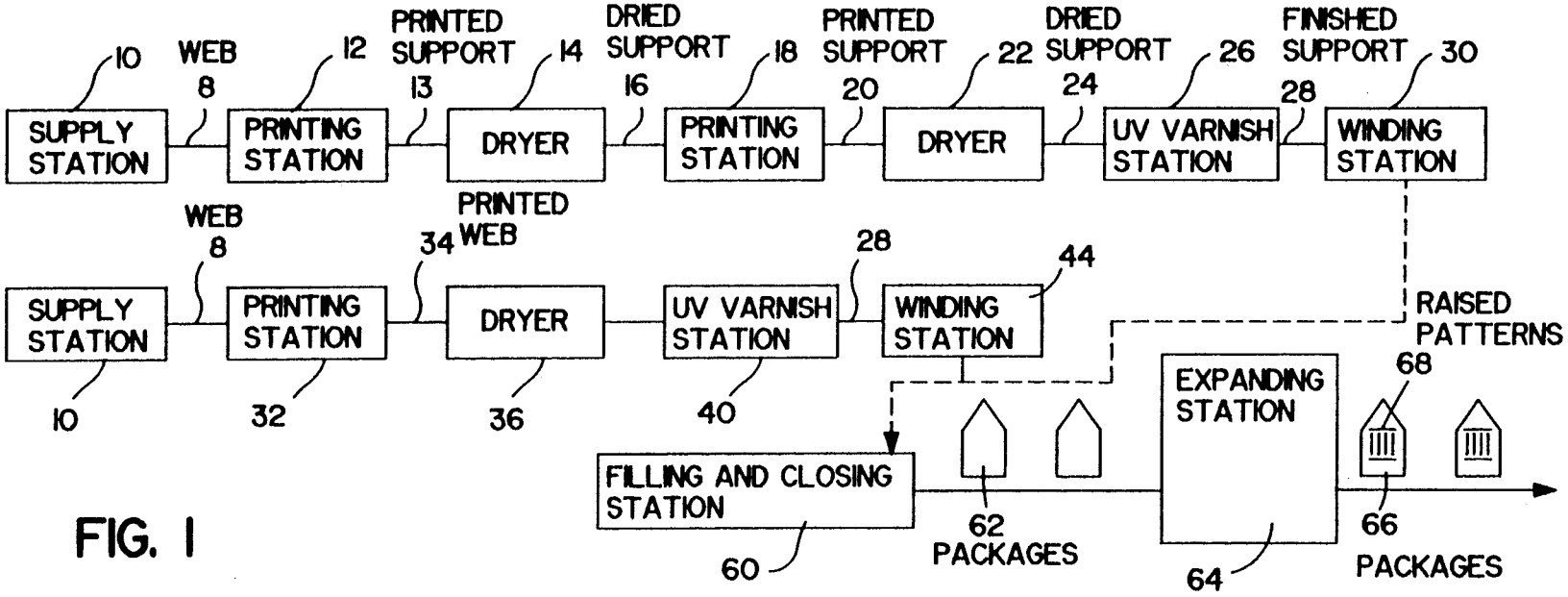
FIG. 1 shows a flow diagram of the method according to the present invention.

The sequence of the overall method according to the invention is as follows (see figures of the drawing):

The two-dimensional material 8 to be printed is unwound in station 10 from a storing coil and transported to station 12 where it is printed on its entire surface or according to a predetermined and desired pattern. The printing mode depends on the subsequent expanding conditions, which will be described below. The expandable ink may be colorless, white or colored, as desired. Several expandable inks of different colorations may of course also be applied in printing station 12.

The printed support 13 is passed into a dryer 14 where the printing of the support is dried. Inside dryer 14, temperatures which already lead to an expansion must be avoided. Consequently, expanding inks will be used whose point of expansion is in the upper area of the temperature range.

The dried support 16 which leaves dryer 14 is introduced into a second printing station 18 where other colors or effects are printed upon and/or outside the places which are coated with expanding ink. With respect to the composition of the shades, their development following the expansion will be taken into account. They are also dried while temperatures below the expanding range are maintained, normally below about 100° C. This second drying takes place in dryer 22.

Finally, the UV varnish is applied to printed support 24 in station 26 which comprises a full-surface photogravure printer and a "drying" or rather a ultraviolet polymerization device. The finished support 28, printed and varnished, is wound up on a coil in winding station 30.

In station 26, the UV varnish may also be partially deposited on the surface of the support in such a manner as to constitute reserves for receiving other types of lacquers such as sealings, release, hot melts, other technical lacquers, etc. All these applications may be provided in station 26 or in one or more additional stations which are not represented in the drawing.

The aspect and behavior of support 28 leaving station 26 or possible additional stations is identical to that of normal printed and varnished products. It may thus be wound up on coils without difficulties nor modifications while forming very regular coils. These coils are delivered to the manufacturer as will be described below.

A first simplified alternative of the procedure is represented in FIG. 1 just below the already described first production line.

The two-dimensional material 8 to be printed leaves supply station 10 as in the first described line, but it enters a printer sation 32 where support 8 is printed varicolored, at least one of the applied inks being a expanding ink. The printed web 34 is then dried in dryer 36 while observing the maximum drying temperature limit indicated above. The remainder of the production line is identical to the previously described one, i.e. it comprises a varnish application and hardening station 40, corresponding to station 26, and a winding station 44 where web 28 is wound up in the form of a coil.

The rest of FIG. 1 will be described below.

Figure 2:
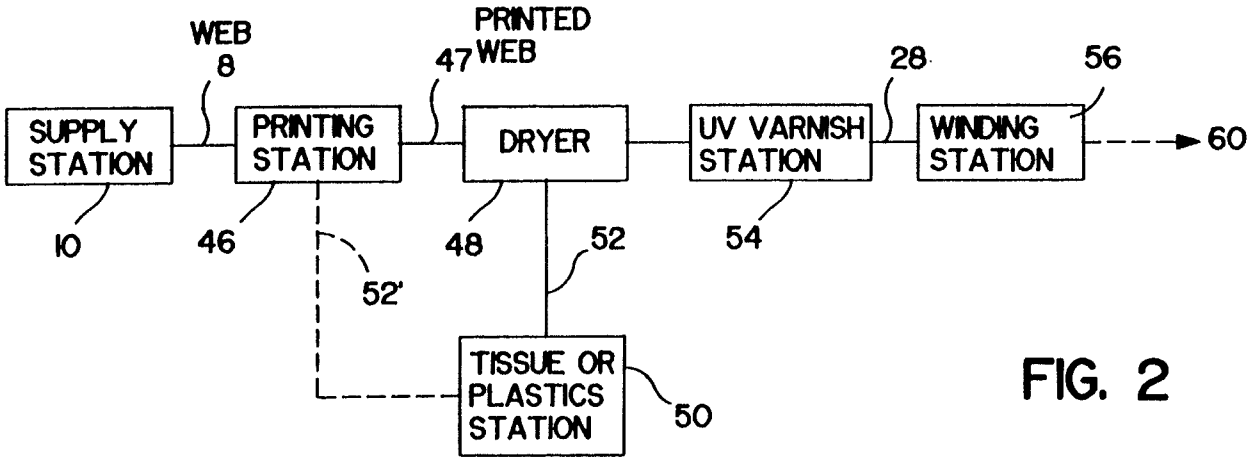
FIG. 2 shows an alternative method according to the present invention, also in the form of a flow diagram.

Reference is now made to FIG. 2 which illustrates in a very schematical manner a principal alternative of the method of the invention which yields a slightly different product than described above.

As in the case of the described procedure, a web of two-dimensional material 8 to be printed leaves supply station 10. It is printed in station 46 with at least one expanding ink as described above. An ink containing a glue is used. Before drying the web 47 leaving printing station 46, either at the entrance of dryer 48 or at the exit of station 46, a web of tissue paper or of thin plastics material 52 or 52' is applied to the printed surface of web 47. During drying of the composite strip, web 52, 52', which must have substantially the same width as web 8, is laminated with said material, that is a UV curable coating is applied, in station 54 if required or desired. The composite strip is subsequently coiled up in the winding station.

Conventional, non-expanding inks may be applied before, after or simultaneously with the expanding ink; these embodiments are not shown in the drawing.

As already mentioned, the varnishing station 54 may be omitted, especially when strip 52 or 52' is formed of plastics material. Alternatively, a tissue paper 52 (52') already impregnated with varnish may be used.

Hereinafter, the second step of the procedure of the invention will be described, said step comprising the delayed expansion. With one exception, this step is identical for all two-dimensional products obtained in the first step.

These products, coming from one of stations 30, 44 and 56, are delivered in bobbins to package manufacturing, filling and closing station 60. The packages 62 leaving said station 60 enter an expanding station 64. The external surface of all the packages 62 is then subjected to the action of an energetic radiation which is capable of heating said surface. Preferably a laser having an out-of-focus beam (not shown) is used whose radiation is directed to the locations on the surface of said package which have been previously provided with expanding ink. The desired expansion takes place without affecting the packed product by heat. The packages 66 leaving expanding station 64 have raised areas or patterns 68 on their surface. Due to the previously applied UV varnish, said obtained relief is protected from mechanical influences during subsequent handling of packages 66, and the varnish coat moreover confers the relief portions a pleasing and decorative mat or brilliant appearance.

However, another expanding technique may be used. If a major portion of the surface of packages 62 or even their entire surface has been printed with expanding ink, a laser, possibly with a variable focus, is preferably used in order to produce the desired relief pattern on the surface, the radiation of said laser being displaced vertically and horizontally in such a manner as to produce the desired relief by the movement of the laser beam on the package surface according to the pattern to be reproduced.

The described expansion can be adapted to produce a relief on other supports which are not packages. For example, banknotes provided with braille indications can be obtained from uncut banknote rolls which have been continuously printed by copper engraving.

The area of the banknote where the value and possibly additional indications are to appear is printed with the expanding ink, and said relief is produced in station 64 by expansion.

Subsequently or beforehand, the printed web is cut into bills.

The method of the invention will find its application in the following technical and commercial fields (the supports being enumerated):

1. Paper, transformed paper, complex paper, coated paper, lacquered paper, laminated paper;

2. Ordinary cardboard, transformed cardboard, complex cardboard, coated, lacquered or laminated cardboard;

3. Ordinary, transformed, complex, coated or laminated aluminum;

4. Ordinary, transformed, complex, lacquered or co-extruded plastic films;

5. Various textile materials, leather, imitation leather.

The possible packages to be produced are not enumerated in detail. The field of applications comprises, e.g., food supplies such as coffee, cosmetics, luxury products, etc. These indications are not limitative.

We claim:

1. A method of manufacturing decorative, shaped objects having at least one surface provided with a decorative relief pattern, which comprises:

(a) continuously printing a web of two-dimensional material with an expandable ink which expands when heated;

(b) drying the printed web at a temperature lower than the temperature at which the ink expands;

(c) coiling the printed and dried web;

(d) transforming the coiled web into shaped objects; and then, (e) expanding the expandable ink to form the relief pattern on the surface of the shaped objects.

2. A method as recited in claim 1, which further comprises applying a non-expanding printing ink before, during, or after the application of said expandable ink.

3. A method as recited in claim 1, wherein the web printing step comprises disposing expandable ink at certain locations on said web corresponding to the relief pattern.

4. The method of claim 1, wherein the web printing step comprises disposing expandable ink on substantially the entire surface of said web.

5. The method of claim 1, which further comprises the steps of formulating a varnish which polymerizes under the action of ultraviolet (UV) radiation, covering the printed and dried web with the varnish, whereby, said varnish is formulated to allow a rapid polymerization while maintaining a sufficient flexibility such that the varnish does not encumber the later expanding of the expandable ink.

6. The method of claim 5, wherein said covering step deposits the varnish partially on the surface of said web to produce reserves for receiving other types of lacquers.

7. The method of claim 1, further comprising the step of laminating the printed web or the printed and dried web with another thinner web of two-dimensional material.

8. The method of claim 1, wherein the step of transforming the coiled, dried, and printed web into shaped objects includes manufacturing filled and closed packages.

9. The method of claim 1, wherein the expanding step comprises irradiating the expandable ink with an out-of-focus laser beam.

10. The method of claim 1, wherein the web printing step disposes expandable ink on substantially the entire surface of said web, and wherein the expanding step comprises irradiating the ink with a laser beam whose position is controlled and guided to produce the relief pattern.

11. The method of claim 1, further comprising, manufacturing security documents.

12. The method of claim 5, wherein the step of transforming the coiled, varnished, dried, and printed web into shaped objects includes manufacturing filled and closed packages.

13. The method of claim 6, wherein said covering step deposits the varnish partially on the surface of said web to product reserves for receiving sealing, release, hot melts or other technical lacquers.

14. The method of claim 5, wherein the step of formulating the varnish further comprises formulating a varnish containing a very reactive system for producing radical polymerization initiators under the influence of ultraviolet radiation and a monomeric binder, whereby, the varnish remains flexible after polymerization.

15. The method of claim 14, wherein the step of formulating the varnish includes formulating a varnish which also contains an increased reactivity prepolymer.

16. A filled package, obtained by the method of claim 1.

* * * * *